US007034234B1

(12) United States Patent
Brillhart

(10) Patent No.: US 7,034,234 B1
(45) Date of Patent: Apr. 25, 2006

(54) SWITCH ASSEMBLY

(75) Inventor: Steven A. Brillhart, Vinton, VA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 11/118,561

(22) Filed: Apr. 29, 2005

(51) Int. Cl.
*H01H 19/06* (2006.01)

(52) U.S. Cl. ..... 200/302.3; 200/302.1; 200/296; 200/336

(58) Field of Classification Search ..... 200/564, 200/567, 296, 302.1, 302.3, 336
See application file for complete search history.

(56) References Cited

U.S. PATENT DOCUMENTS

| | | | | |
|---|---|---|---|---|
| 3,571,534 | A * | 3/1971 | Ashman | 200/11 D |
| 3,987,265 | A * | 10/1976 | Piber | 200/296 |
| 4,439,654 | A * | 3/1984 | Bresin et al. | 200/302.1 |
| 4,719,324 | A * | 1/1988 | Kuratani | 200/11 R |
| 5,541,377 | A * | 7/1996 | Stuhlmacher | 200/296 |
| 6,130,389 | A * | 10/2000 | Rao | 200/296 |
| 6,509,823 | B1 * | 1/2003 | Meckler et al. | 337/112 |

* cited by examiner

*Primary Examiner*—Michael A. Friedhofer
(74) *Attorney, Agent, or Firm*—RatnerPrestia

(57) ABSTRACT

A switch assembly held in a support member by a bushing mounted to the support member by a clip carried in an outer groove formed on the bushing. A compressible seal ring is carried in another outer groove formed on the bushing so that the seal ring acts on another surface of the support member to form a seal.

12 Claims, 1 Drawing Sheet

SWITCH ASSEMBLY

Figure 1:
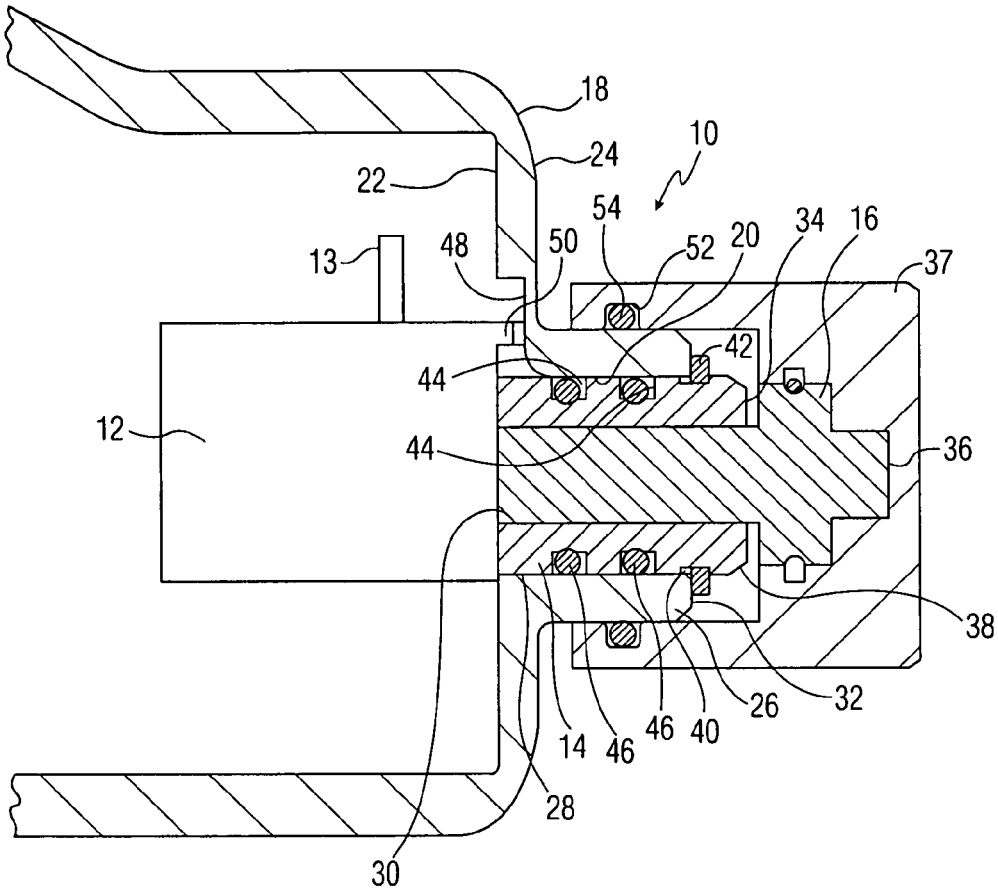

This invention relates to a switch assembly and more particularly to an arrangement for mounting a switch assembly to a panel or housing or the like.

BACKGROUND OF THE INVENTION

Switch assemblies, including on/off switches and variable switches such as potentiometers are usually mounted to panels or housings by a threaded arrangement. Usually there is an external thread on the switch assembly that cooperates with a nut or internal thread formed in the panel or housing to clamp the switch in place. Assembly of the switch assembly to the panel or housing is time consuming and, of course, presents over tightening or under tightening problems.

If the switch assembly is used in applications where sealing is important, there are additional considerations. In the threaded arrangements noted above, sealing is effected by a rubber boot arranged with the switch assembly on the outside of the panel or housing. If the panel or housing is part of a device used outdoors or in other harsh conditions, e.g., if the device is a night vision goggle used by military, law enforcement, emergency personnel or rescue workers, the boot can be cut or otherwise ripped open. The sealing effect is then diminished if not entirely lost.

SUMMARY OF THE INVENTION

This invention comprises a switch assembly including an electrical switch and a bushing having one end fixedly associated with the switch and a free end spaced therefrom. The bushing is formed with a generally cylindrical outer surface and a passage extending between its two ends. The switch assembly includes an operating stem rotatably arranged in this passage and terminating in a free end located outwardly of the free end of the bushing. The operating stem is operatively coupled to the switch for controlling its operation. The generally cylindrical outer surface of the bushing is formed with a first groove adjacent its free end for receiving a clip that retains the switch assembly to a support surface; the outer surface of the bushing is also formed with a second groove between the one end of the bushing and the first groove. A compressible ring is carried in the second groove and provides a seal between the bushing and the support member.

DETAILED DESCRIPTION OF THE DRAWINGS

The FIGURE in the accompanying drawing is a partial longitudinal cross-sectional view of a switch assembly in accordance with an exemplary embodiment of the invention showing a support surface on which the switch assembly is mounted.

DETAILED DESCRIPTION OF THE INVENTION

Referring to the drawing, there is disclosed a switch assembly 10 including a switch 12 or a potentiometer or other electrical control device, a bushing 14 and an operating stem 16. The switch assembly 10 is shown mounted to a support member 18 which can be a control panel or the wall of a housing forming part of a device with which the switch 12 is used. In the exemplary embodiment disclosed here, the support member is the outer surface of a housing for night vision goggles and the switch 12 includes a pin 13 for connecting it into an electric circuit. The support member 18 is formed with an opening extending between its inner surface 22 and the outer surface 24. Extending outwardly from the outer surface 24 is a generally cylindrical boss 26 having a central opening that is aligned with the opening between the inner and outer surfaces to form a passage 20 extending from the inner surface 22 to the free end 32 of the boss 26. It should be understood that the boss 26 may vary in length or be omitted, if desired.

The bushing 14 is fixedly associated with the switch 12 and may be connected to or formed with the switch 12. The bushing 14 is formed with a generally cylindrical outer surface 28 and a central passage 30 in which the operating stem 16 is rotatably received. The bushing 16 is received in the passage 20 and extends beyond the free end 32 of the boss 26 where it too terminates in a free end 34.

The stem 16 also terminates in a free end 36 which is outward of the outer surface 24 of the housing and the free end 34 of the bushing 14 so that it is accessible to a user of the device. To this end, the free end 36 is formed with a configuration that facilitates retaining a control knob 37 to facilitate rotation of the operating stem 16 and, thus, control the switch 12.

The bushing 14 also includes a free end 34 located between the free end 32 of the boss 26 and the free end 36 of the operating stem 16. The outside diameter of the free end 34 is less than the diameter of the generally outer cylindrical surface 28 of the bushing 16 so that an inclined surface 38 is formed. Adjacent the tapered surface 38, the generally cylindrical outer surface 28 is formed with a groove 40 that is radially adjacent to the free end 32 of the boss 26. A resilient clip 42 is carried in the groove 40 and one surface of the clip bears on the free end 32 of the boss 26. The opposite surface of the clip bears on the axially outermost radial surface of the groove 40 to retain the switch assembly 10 on the support member 18.

The resilient clip 42 can be any resilient annular piece capable of being assembled in the groove 40. In the exemplary embodiment disclosed here, the clip 42 is a split, washer shaped member. It is easily assembled by locating it adjacent the free end 34 of the bushing 14 and sliding it along the tapered surface 38 toward the groove 40. The tapered surface 38 expands the inside diameter of the clip 42 until is seats over, contracts and snaps into the groove 40. C-rings, circlips, disc washers etc. can be used as the clip 42.

Intermediate the groove 40 and the switch 12, the generally cylindrical outer surface 28 is formed with at least one groove 44. In the exemplary embodiment disclosed here, there are two such grooves 44 as shown in the drawing. Regardless of their number, the grooves 44 are radially adjacent the inner wall forming the passage 20 and each groove 44 carries a resilient seal ring 46 that is compressible in its groove by the inner wall forming the passage 20 so that a seal is effected.

The inner surface 22 of the support member 20 can be formed with a groove 48 that receives a finger 50 formed on the switch 12 so that the switch assembly 10 is properly oriented on the support member 20.

The control knob 37 is a cup shaped member the circular wall of which is configured to fit on the free end 36 of the operating stem 16. The cylindrical wall of the central knob 37 is formed with a groove 52 in which a compressible seal ring 54 is located to form a seal with the outer surface of the boss 26.

While an exemplary embodiment of the invention is disclosed herein, it should be understood that changes and modifications can be made.

The invention claimed is:

1. A switch assembly comprising an electrical switch and a bushing having one end fixedly associated with the switch and a free end spaced therefrom; the bushing having a generally cylindrical outer surface forming a passage extending between the ends thereof; an operating stem operatively coupled to the switch for controlling operation of the switch, the operating stem being rotatably carried in the passage and terminating in a free end located outwardly of the free end of the bushing; the outer generally cylindrical surface of the bushing being formed with a first groove adjacent the free end of the bushing for receiving a clip that retains the switch assembly on a support member, wherein the outer generally cylindrical surface is formed with a second groove intermediate the first groove and the switch and a compressible seal ring is carried in the second groove.

2. A switch assembly in accordance with claim 1 wherein a tapered surface is formed on the bushing adjacent the free end of the bushing and the first groove.

3. A switch assembly in accordance with claim 1 wherein the free end of the operating stem is configured to receive a control knob.

4. A switch assembly in accordance with claim 1 wherein a third groove is found between the second groove and the switch and another compressible seal ring is carried in the third groove.

5. A switch assembly in accordance with clam 1 wherein the switch includes a finger for orienting the switch assembly on the support member.

6. A switch assembly mounted on a support member, said switch assembly comprising an electrical switch and a bushing having one end fixedly associated with the switch, the switch bearing on one surface of the support member and the bushing having a generally cylindrical outer surface received in a passage extending from the one surface to the opposite surface of the support member, the bushing terminating in a free end located outwardly of the opposite surface and having a central passage extending between the ends, an operating stem operatively coupled to the switch for controlling operation of the switch, the operating stem being rotatably carried in the bushing's central passage and terminating in a free end located outwardly of the free end of the bushing; the outer generally cylindrical surface of the bushing being formed with a first groove adjacent the opposite surface of the support member, a resilient clip in the first groove for retaining the switch assembly with the support member, the outer generally cylindrical surface of the bushing being formed with a second groove adjacent the wall of the support member that surrounds the passage therein, a compressible seal ring carried in the second groove for effecting a seal between the bushing and the support member.

7. A switch assembly in accordance with claim 6 wherein a tapered surface is formed on the bushing adjacent the free end of the bushing and the first groove.

8. A switch assembly in accordance with claim 6 wherein a third groove is found between the second groove and the switch and another compressible seal ring is carried in the third groove.

9. A switch assembly in accordance with claim 6 wherein the switch includes a finger for orienting the switch assembly on a support member.

10. A switch assembly in accordance with claim 6 wherein the clip is a resilient split ring.

11. A switch assembly in accordance with claim 6 wherein the free end of the operating stem is configured to receive a control knob.

12. A switch assembly in accordance with claim 11 including a compressible seal between the control knob and the support member.

* * * * *